US007211198B2

(12) United States Patent
Barraza et al.

(10) Patent No.: US 7,211,198 B2
(45) Date of Patent: May 1, 2007

(54) SURFACTANT COMPOSITIONS

(75) Inventors: Harry Javier Barraza, Wirral (GB); Teodora Atanassova Doneva, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 11/301,420

(22) Filed: Dec. 13, 2005

(65) Prior Publication Data

US 2006/0160715 A1 Jul. 20, 2006

(30) Foreign Application Priority Data

Dec. 14, 2004 (GB) ..... 0427308.2

(51) Int. Cl.
*C11D 3/08* (2006.01)

(52) U.S. Cl. ..... 252/8.62; 252/8.61; 510/276; 510/392; 510/513; 510/530; 428/447; 8/101

(58) Field of Classification Search ..... 510/189–419, 510/513, 530; 424/70.13–70.14, 59; 252/8.62, 252/8.61; 428/447; 8/101
See application file for complete search history.

(56) References Cited

U.S. PATENT DOCUMENTS

2002/0065208 A1 5/2002 Aubay et al.
2002/0151634 A1 10/2002 Rohrbaugh et al.
2004/0038851 A1 2/2004 Aubay et al.
2004/0120915 A1* 6/2004 Yang et al. ..... 424/70.13

FOREIGN PATENT DOCUMENTS

| | | |
|---|---|---|
| DE | 102 48 583 | 10/2002 |
| DE | 102 48 583 | 4/2004 |
| EP | 1 371 718 | 12/2003 |
| EP | 1371718 | 12/2003 |
| WO | 02/064877 | 8/2002 |
| WO | 02/18451 | 9/2003 |
| WO | 2004/060330 | 7/2004 |
| WO | 2004/082611 | 9/2004 |

OTHER PUBLICATIONS

*International Search Report, PCT/EP2005/012863*, mailed Mar. 1, 2006, 2 pp.
*GB Search Report, GB 0427308.2*, dated Apr. 21, 2005, 1 p.

* cited by examiner

*Primary Examiner*—Douglas McGinty
*Assistant Examiner*—Tri Nguyen
(74) *Attorney, Agent, or Firm*—Alan A. Bornstein

(57) ABSTRACT

Laundry treatment compositions comprising 0.001–5 wt % of monomeric hybrid organic/inorganic nanoparticles having a particle size of 1–10 nm and 10–95% surfactant give ease of wash benefits to soiled fabric as well as prevention of adsorption of particulate soils.

5 Claims, No Drawings

SURFACTANT COMPOSITIONS

TECHNICAL FIELD

The present invention relates to improvements relating to surfactant compositions, a method of treatment of textiles and a nano-composite textile.

BACKGROUND OF THE INVENTION

It is well known to use particles to modify the surface of cotton fibres. Consequently, particulate inorganic materials such as clays, silica and alumino-silicate have been widely used in detergent compositions. Typically, these are present as 'softeners' which associate with the surfaces of fibres and fibrils of cotton.

In recent years it has been proposed to use so-called 'nanoparticles' for fabric treatment. WO 02/064877 (P&G) discloses coating compositions, which comprise a 'nanoparticle' system of a size of less than or equal to 750 nm, with a lower limit of '0' nm. Examples provided include synthetic silica (10–40 nm), boehemite alumina (2–750 nm) and 'nanotubes' (2–50 nm). Clays, particularly plate-like laponites (25–40 nm wide and ~1 nm thick) are considered suitable and organic materials such as nano-latexes are proposed.

Nanosilica particles are negatively charged and are not expected to deposit on the fabric surface (also negatively charged) during wash because of their negative charge. At pH 8, for example, the Zeta-potential of a nanosilica was measured to be −21 mV.

EP 1371718 (Rohm and Haas) discloses 1–10 nm polymeric nanoparticles as a fabric care additive. These can be organically modified with silicones.

WO 02/18451 (Rhodia) discloses the use of nanoparticles in a polymeric or nano-latex form.

DE 10248583 (Nanogate Technologies GmbH) discloses the use of inorganic nanoparticles as a carrier for a silane material.

BRIEF DESCRIPTION OF THE INVENTION

We have determined that it is advantageous to use monomeric hybrid organic/inorganic nanoparticles of the size range 1–10 nm. These materials are not polymeric and typically comprise an inorganic core with chemically bound organic pendant groups.

Accordingly therefore, the present invention provides a laundry treatment composition comprising:

a) 0.001–5% wt of monomeric hybrid organic/inorganic nanoparticles having a particle size of 1–10 nm, b) 0.1–95% wt of surfactant c) optionally, one or more of enzymes, perfumes, bleach, and sequesterants.

A first benefit of the present invention is believed to be that fabrics treated with the composition are easier to wash after subsequent soiling.

According to a further aspect of the present invention there is provided a method of treating cellulosic textiles, which comprises contacting the textile with a solution of the composition according to the present invention.

Textile here is intended to mean both a fibre in the form of a yarn, and especially, in the form of a woven or knitted garment. Generally the method of the invention will be applied as part of a domestic laundering process although it can also be applied as finishing process in textile or garment manufacture.

While not wishing to be limited by any theory of operation, it is believed that the nanoparticles of the composition of the invention penetrate into the cellulosic regions of the cotton fibre rather than simply associating with the surface of the fibres or penetrating into the lumen of the fibres. It is considered that the mechanism of delivery of nanoparticles is nano-filtration, through cotton fibre pores. These pores are believed to be of a typical size between 5–9 nm.

It is also believed that nanoparticles prevent the absorption of particulate soil into cotton fibre pores.

This is believed to be due to two mechanisms. In the first of these, the nanoparticles are thought to block the pores and prevent adsorption of particulate soils.

It is preferable that the nanoparticles are negatively charged under the conditions of a domestic wash, i.e. that they have a negative Zeta-potential at an alkaline pH suitable for washing clothes. It is believed that this enables the particles to deliver additional negative charge to the fabric therefore decreasing the deposition tendency of soils.

It would appear that it is particularly advantageous to use nanoparticles for cotton treatment which are close to the pore size of the cellulosic region of the cotton fibre (5–9 nm) and which have a negative Zeta potential at pH 8. While these negatively charged particles are naturally repelled from the fibre surface it is believed that their nano-scale dimensions are small enough that the particles can enter the pores of the fibre and become physically trapped.

Further benefits of the inventions relate to the mechanical properties of fabrics treated with the composition. The nanoparticles are believed to cause an increase in the flexural rigidity of the fabric, which enhances the fibre resistance to creasing. In addition, there are tactile benefits, believed to be associated with a reduction in friction. It is envisaged that such a reduction in friction would have secondary benefits, as a reduction in fibre-fibre friction is believed to prevent fibre damage and therefore reduce pilling and loss of colour.

While the mechanism why the invention works remains speculative, to some extent the present invention also extends to nano-composite cellulosic material obtainable by the method of the invention. Such a material may be in the form of a yarn or in the form of a cloth, or in the form of a finished garment.

As noted above, the nanoparticles are organically modified, inorganic nanoparticles. Preferably these are organically modified siloxanes. Suitable molecules include polyhedral oligomeric silsesquioxane (POSS) species. Preferred POSS species are of the general formula:

$$(R^1)_m(\text{—OH})_n\text{—}O_hSi_g$$

Wherein h=3a, g=2a (for a=4 or 6), m+n=g. Preferably, R1 is independently selected from C1–C6 alkyl, aryl or cycloalkyl, phenyl, $O^-$, trifluoropropyl, trimethylsiloxy, phenyl ethyl.

Ionic R1 groups are preferred, particularly, for the reasons given above ones which bear a negative charge. More preferably the materials are water soluble or dispersible.

In a preferred embodiment the nanoparticles comprise octa-trimethylamine POSS ($C_{32}H_{96}N_8O_{20}Si_8$—CAS registry number [69667-29-4]). Suitable counter-ions include quaternary ammonium ions such as $NMe_4^+$.

A range of POSS materials are available in the marketplace as Nanostructured™ Chemicals from the Hybrid Plastics company (www.hybridplastics.com).

DETAILED DESCRIPTION OF THE INVENTION

Various preferred and/or optional features of the product and method aspects of the present invention are described in further detail below. As used elsewhere in the specification all percentages are percentages by weight unless the context demands otherwise.

Product Form:

The composition of the invention may be in the form of a liquid, solid (e.g. powder or tablet), a gel or paste, spray, stick or a foam or mousse. Examples include a soaking product, a rinse treatment (e.g. conditioner or finisher) or a main-wash product.

Liquid compositions may also include an agent which produces a pearlescent appearance, e.g. an organic pearlising compound such as ethylene glycol distearate, or inorganic pearlising pigments such as microfine mica or titanium dioxide ($TiO_2$) coated mica. Liquid compositions may be in the form of emulsions or emulsion precursors thereof.

Surfactants:

The surfactant may be chosen from soap and non-soap anionic, cationic, nonionic, amphoteric and zwitterionic detergent active compounds, and mixtures thereof.

Surfactants can assist with the delivery of hydrophobic nanoparticles, particularly so-called linear hybrid monomers.

An example of such a linear hybrid monomer is the molecular silica sold under the trade name 'iso-octyl POSS cage mixture', whose chemical formula is $C_{64}H_{88}O_{12}Si_8$. These nanoparticles are intrinsically insoluble in water due to the iso-octyl chains covalently bonded to the silica structure.

Many suitable surfactants are available and are fully described in the literature, for example, in "Surface-Active Agents and Detergents", Volumes I and II, by Schwartz, Perry and Berch (Wiley Interscience).

The preferred surfactants that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are independently hydrocarbyl chains of $C_1$–$C_{22}$ length, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5–55 wt %, such as 5–50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

Viscous liquid nanoparticle containing material can be heated, preferably to a temperature greater than 60 Celsius to obtain a significant drop in viscosity. This can then be admixed with a surfactant containing solution, preferably under high shear, to obtain a dispersion. Symperonic™ A7 (C13E6.5) is a suitable surfactant.

This concentrated dispersion can be either added as is in a final liquid detergent formulation or can be further processed (i.e., spray drying) to incorporate the hydrophobic nanoparticles load into a powder detergent formulation.

Alternative routes to deliver the hydrophobic nanoparticles is by mixing the viscous molecular silica with a suitable oil, which may be a perfume oil, that would serve as a carrier.

Builders:

The compositions may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5M_2O.Al_2O_3.0.8\text{–}6SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

Alternatively, or additionally to the aluminosilicate builders, phosphate builders may be used.

Textile Softening and/or Conditioner Compounds:

If the composition of the present invention is in the form of a textile conditioner composition, the surfactant will be a textile softening and/or conditioning compound (hereinafter referred to as "textile softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the textile in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic textile softening compounds are substantially water-insoluble quaternary ammonium materials comprising a single alkyl or alkenyl long chain having an average chain length greater than or equal to $C_{20}$. More preferably, softening compounds comprise a polar head group and two alkyl or alkenyl chains having an average chain length greater than or equal to $C_{14}$. Preferably the textile softening compounds have two, long-chain, alkyl or alkenyl chains each having an average chain length greater than or equal to $C_{16}$.

Most preferably at least 50% of the long chain alkyl or alkenyl groups have a chain length of $C_{18}$ or above. It is preferred if the long chain alkyl or alkenyl groups of the textile softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The textile softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble textile softening compounds are defined as textile softening compounds having a solubility of less than $1\times10^{-3}$ wt % in demineralised water at 20° C. Preferably the textile softening compounds have a solubility of less than $1\times10^{-4}$ wt %, more preferably less than $1\times10^{-8}$ to $1\times10^{-6}$ wt %.

Especially preferred are cationic textile softening compounds that are water-insoluble quaternary ammonium materials having two $C_{12-22}$ alkyl or alkenyl groups connected to the molecule via at least one ester link, preferably two ester links. Di(tallowoxyloxyethyl)dimethyl ammonium chloride and/or its hardened tallow analogue are especially preferred of the compounds of this type. Other preferred materials include 1,2-bis(hardened tallowoyloxy)-3-trimethylammonium propane chloride. Their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic textile softeners, as described in GB 2 039 556B (Unilever).

The compositions may comprise a cationic textile softening compound and an oil, for example as disclosed in EP-A-0829531.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180). The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

Other Components

Compositions according to the invention may comprise soil release polymers such as block copolymers of polyethylene oxide and terephthalate.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, fluorescers, colourants, hydrotropes, antifoaming agents, enzymes, optical brightening agents, and opacifiers.

Suitable bleaches include peroxygen bleaches. Inorganic peroxygen bleaching agents, such as perborates and percarbonates are preferably combined with bleach activators. Where inorganic peroxygen bleaching agents are present the nonanoyloxybenzene sulphonate (NOBS) and tetra-acetyl ethylene diamine (TAED) activators are typical and preferred.

Suitable enzymes include proteases, amylases, lipases, cellulases, peroxidases and mixtures thereof.

In addition, compositions may comprise one or more of anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. The lists of optional components are not intended to be exhaustive.

Lubricants and other 'wrinkle release' agents are a particularly preferred optional component of compositions according to the invention.

In order that the invention may be further and better understood it will be described below with reference to several non-limiting examples.

EXAMPLE 1

In this and in the following examples polyhedral oligomeric silsesquioxane (POSS), size 3–7 nm was used, unless stated otherwise. This material is available from Hybrid Plastics (www.hybridplastics.com).

In a model (bottle) main-wash, woven cotton sheeting and Poplin fabrics (fabric weight 2.7 g) were treated at pH 8 in an aqueous dispersion of POSS in the absence of surfactants. Experiments were performed at a 1:8 cloth to liquor ratio. Four loading levels of POSS on weight of fabric (owf) were used: 0.5% owf, 1% owf, 2% owf and 5% owf. The samples were placed in a water-bath at 40° C. and were shaken for 40 min.

Particle deposition on cloths (mg silica/g fabric) was quantified by Inductively Coupled Plasma (ICP) element analysis.

After being washed and dried the cloths were ironed, conditioned at relative humidity 65% and 20° C. for 24 h and their mechanical properties: crease recovery angle (CRA) and bending length (BL) were further measured. CRA technique gives information about wrinkle resistance and recovery properties of fabrics and the bending length for their flexural rigidity.

Nano-silica (3–7 nm) at 5% owf gave a significant increase of the rigidity (~35% increase) with both fabrics.

Deposited silica levels [0.6–1.1 mg silica/g fabric] gave best CRA benefits (~18% improvement). Any further increase in the deposited silica led to a decrease of the CRA. This could be a result of particle aggregation and full plugging of pores which impedes the recovery of already formed wrinkles.

SEM-Si mapping (EPMA) of cross-sections of the nano-silica treated fabric demonstrated that the silica is positioned inside the wall of the fibre-mostly in the cellulose porous part and less in the lumen.

EXAMPLE 2

Cotton sheeting fabrics were washed according the protocol described in example 1 above with nano-silica present at 2% owf. For comparison, colloidal silica of significantly larger size and different morphology was also used. After drying the same monitors were soiled with low concentrations of carbon black and Bandy black clay. Further cloths were tested for reflectance at 460 nm. Results are shown in Table 1 below.

TABLE 1

Cotton sheeting fabrics-redeposition study

| Fabric Sample | Reflectance 460 nm |
|---|---|
| Untreated cotton | 89 (0.16) |
| Untreated + Soiled with Carbon black | 77 (1.03) |
| Untreated + Soiled with clay | 83 (0.51) |
| Cotton treated (−ve charged) nanosilica | 88 (0.14) |
| Treated + Soiled with Carbon black | 82 (0.83) |
| Treated + Soiled with clay | 85 (0.75) |
| Cotton treated (+ve charged) silica (50 nm) | 88 (0.22) |
| Treated + Soiled with Carbon black | 78 (1.29) |
| Treated + Soiled with clay | 83 (0.82) |

Data in brackets show 95% confidence.

Both clay and carbon black are typical laundry particulate soils. It is believed that carbon black and Bandy black clay are poly-disperse systems of wide size distribution (1 nm–2 microns). From table 1 (upper triad of results) it can be seen that the reflectance is reduced significantly by soiling with both carbon black and clay (max. difference=12).

The middle triad of results shows only a small decrease in the reflectance of treated monitors before and after soiling (max. difference=6). It is believed that the fabric treated with nano-silica can be considered as a nano-composite textile and that nanoparticles inside the fibre pores prevent soil deposition inside the fibre. In addition the electrostatic repulsion between negatively charged silica and the soil particles (also negatively charged) results in less soiling.

In the third triad of results colloidal silica of size 50 nm was used as a comparison. This silica is believed to be positively charged and to modify the fibre surface without penetrating inside it. It can be seen that the reflectance was significantly changed as a result of soiling.

EXAMPLE 3

Fabric saturated with a test solution was forced between pressure controlled rollers (the padder) to squeeze excess solution from the fabric, leaving the desired amount of material on the fabric. Fabrics were line-dried before testing.

Mechanical properties (stiffness and elasticity) of cotton sheeting fabrics padded with 2% owf POSS nano-silica were tested using Kawabata shear technique. This measures inter-fibre friction and gives information about the fabric shear stiffness (G) and shear elasticity (2HG5). Nano-particulate silica treated cotton sheeting fabrics show increased stiffness (+25%) and reduced elasticity (−20%).

Surface friction coefficient was measured for cotton sheeting treated with nano-silica and found (using the Eldredge Tribometer) to be substantially lower than that of untreated fabric under both dry and wet conditions.

EXAMPLE 4

The damage of blue drill cotton padded with 2% owf POSS nano-silica was assessed through SEM analysis of fabric fibrillation and measurement of the fabric-fabric friction coefficient using the Eldredge Tribometer and compared to the damage of drill cotton both untreated and treated with other lubricant materials.

The comparison lubbricant was formed by admixing 28 g of glycerol monoisostearate (Prisorine™ 2040, Uniquema, Wirral, UK) with 12 g of polydimethylsiloxane PEG isostearate blend (Silwax™ DMC-IS, Siltech, Ontario, Canada).

The surface friction measured at wet conditions (wash liquor, pH 10) for the drill cotton treated with nano-silica was significantly lower than the friction of untreated cloth and also lower than those of the fabric treated with the comparison lubricant (also at 2% owf).

EXAMPLE 5

Preparation of a Surfactant Containing Composition

This example was performed with 'iso-octyl POSS cage mixture' (ex Hybrid Plastics, whose chemical formula is $C_{64}H_{88}O_{12}Si_8$. The viscous liquid comprising the nanoparticles was heated to a temperature slightly greater than 60 Celsius at which point a significant drop in viscosity is observed.

0.5 g of the heated liquid containing the hydrophobic nanoparticles was added drop-wise to a container with 20 ml of a concentrated surfactant solution (10 g/l) of Symperonic A7 (C13E6.5) in water. The liquid was stirred using a universal electronic stirrer (Heidolph RZR 2051, Heidolph Instruments GmbH & Co. KG, Schwabach, Germany) at 1500–2000 rpm for a total of 5 to 10 minutes. A concentrated emulsion of droplets containing the hydrophobic nanoparticles in water is obtained.

The invention claimed is:

1. A laundry treatment composition comprising:

a) 0.001–5%wt of monomeric anionic hybrid organic/inorganic nanoparticles having a particle size of 3–7 nm;

b) 10–95% of surfactant;

c) optionally, one or more of enzymes, perfumes, bleach, sequesterants; and d) wherein the nanoparticles are polyhedral oligomeric silsesquioxane (POSS) species of the general formula $(R_1)_m(—OH)_n—O_hSi_g$ wherein h=3a, g=2a (for a=4 or 6), m+n=g, and, wherein $R^1$ is independently selected from C1–C6 alkyl, aryl or cycloalkyl, phenyl, $O^-$, trifluoropropyl, trimethylsiloxy, and phenyl ethyl.

2. Composition according to claim 1 wherein the R1 group is ionic.

3. Composition according to claim 2 wherein the nanoparticles comprise octa-trimethylamine POSS ($C_{32}H_{96}N_8O_{20}Si_8$—CAS[69667-294]).

4. A method of treating cellulosic textiles, which comprises contacting the textile with a solution of the composition according to a claim 1.

5. A nano-composite cellulosic textile material comprising cellulose fibres having anionic hybrid organic/inorganic nanoparticles adsorbed into the pores of the fibres, wherein the nanoparticles have a particle size of 3–7 nm and are polyhedral oliqomeric silsesquioxane (POSS) species of the general formula $(R^1)m(—OH)n\text{-}O_hSi_g$ wherein h=3a, g=2a (for a=4 or 6), m+n=g, and, wherein $R^1$ is independently selected from $C_1$–$C_6$ alkyl, aryl or cycloalkyl, phenyl, $O^-$, trifluoropropyl, trimethylsiloxy, and phenyl ethyl.

* * * * *